United States Patent [19]

Imbault et al.

[11] Patent Number: 4,676,715

[45] Date of Patent: Jun. 30, 1987

[54] TURBINE RINGS OF GAS TURBINE PLANT

[75] Inventors: Jean-François R. Imbault, Ponthierry; Roland R. Mestre, Melun; Carmen Miraucourt, Brie Comte Robert; Rémy P. C. Ritt, Vaux le Penil, all of France

[73] Assignee: Societe Nationale d'Etude et de Construction de Moteurs d'Aviation, Paris, France

[21] Appl. No.: 822,806

[22] Filed: Jan. 27, 1986

[30] Foreign Application Priority Data

Jan. 30, 1985 [FR] France ..... 85 01266

[51] Int. Cl.[4] ..... F01D 5/08

[52] U.S. Cl. ..... 415/116; 415/174

[58] Field of Search ..... 415/115, 116, 134, 135, 415/136, 137, 138, 170 R, 172 A, 174

[56] References Cited

U.S. PATENT DOCUMENTS

| | | | |
|---|---|---|---|
| 3,966,356 | 6/1976 | Irwin | 415/174 |
| 4,087,199 | 5/1978 | Hemsworth | 415/174 |
| 4,303,371 | 12/1981 | Eckert | 415/116 |
| 4,460,311 | 7/1984 | Trappman et al. | 415/116 |
| 4,468,168 | 8/1984 | Aubert | 415/116 |

FOREIGN PATENT DOCUMENTS

| | | | |
|---|---|---|---|
| 1189849 | 10/1959 | France . | |
| 2416345 | 8/1979 | France | 415/116 |
| 2540938 | 8/1984 | France . | |
| 2540937 | 8/1984 | France . | |
| 2076475 | 12/1981 | United Kingdom . | |

*Primary Examiner*—Robert E. Garrett
*Assistant Examiner*—John Kwon
*Attorney, Agent, or Firm*—Oblon, Fisher, Spivak, McClelland & Maier

[57] ABSTRACT

A turbine ring assembly is mounted on an annular carrier secured to the interior of the casing of a turbine and includes a succession of contiguous sectors of a ceramic abradable material. The sectors have grooves in which support fingers are engaged rigid with an annular member connected to the casing of the turbine. The sectors are thereby held in an annular configuration and the support fingers are so located in the grooves as to provide a screen to prevent reintroduction of hot gases.

4 Claims, 5 Drawing Figures

TURBINE RINGS OF GAS TURBINE PLANT

BACKGROUND OF THE INVENTION

1. Field of the Invention

This invention relates to gas turbines, more particularly to turbine rings, that is the component of the turbine itself which surrounds at least the rotor blades.

2. Summary of the Prior Art

French patents published under nos. 2 371 575, 2 540 937, 2 540 938, 2 540 939 describe various forms of turbine rings each comprising (1) an annular carrier secured to the interior of the turbine casing and (2) an annulus comprised at least partially of abradable material and secured in its turn to the interior of the annular carrier. In most of these previously proposed constructions, the annular carrier is of a metallic material, so that when the abradable material is a ceramic material, as a result of the substantial difference in the coefficients of expansion of metallic materials and ceramic materials the annulus of ceramic material must be built up of sectors independent of one another and interconnected by their respective ends in order to enable at the radius of the abradable annulus the matching of changes in the radius of the carrier annulus as a function of the different temperatures which the latter assumes during different operational ratings of the turbine. As a result the abradable annulus will not be subject to stresses which are incompatable with the mechanical strength of the ceramic material which constitute it.

An object of the present invention is to provide a turbine ring incorporating an improved coupling method between the sectors mounted on the annular carrier in order to reduce to a minimum the tensile stresses which ceramic materials cannot readily accommodate.

SUMMARY OF THE INVENTION

According to the present invention there is provided in a turbine ring assembly, a turbine casing, an annular carrier secured in the interior of the casing, an annulus of abradable sectors, each sector having two opposed grooves, a plurality of circumferentially spaced, axially-extending support fingers, and an annular member forming a part of the annular carrier secured to the turbine casing and from which the support fingers extend axially, each support finger being engaged in one said groove of the sectors whereby to support and maintain the annulus of sectors irrespective of temperature changes occuring during operation.

Sealing between the flanks of contiguous sectors can advantageously be effected by strips axially engaged in opposed appropriately-sized grooves machined at the corresponding radial zone on the opposed flanks of the said contiguous sectors.

In one preferred embodiment of the present invention, the annular member of the annular carrier comprises orifices through which jets of cooling air can pass, these orifices being inclined in such a manner as to direct the jets on the adjacent support fingers.

Furthermore, omega-shaped springs interposed between the sectors and a cylindrical annular outer member also forming a part of the annular carrier ensure a positive contact between the support fingers and the axial grooves formed in the sectors.

In accordance with one specific feature of the preferred embodiment the annular space disposed radially outwardly beyond the annulus sectors is subdivided into two cavities the one serving for cooling of the sectors and the other for controlling the expansions of the stator and as a result clearances which result therefrom between the rotor and the stator of the turbine.

DESCRIPTION OF THE PREFERRED EMBODIMENT

Figure 1:
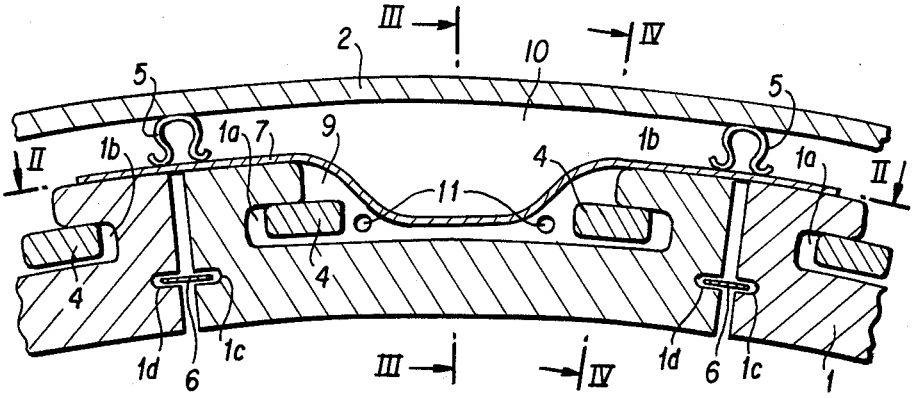
FIG. 1 is a fragmentary diagrammatic section on the line I—I of FIG. 3, of one embodiment of a turbine ring assembly in accordance with the present invention.
Figure 2:
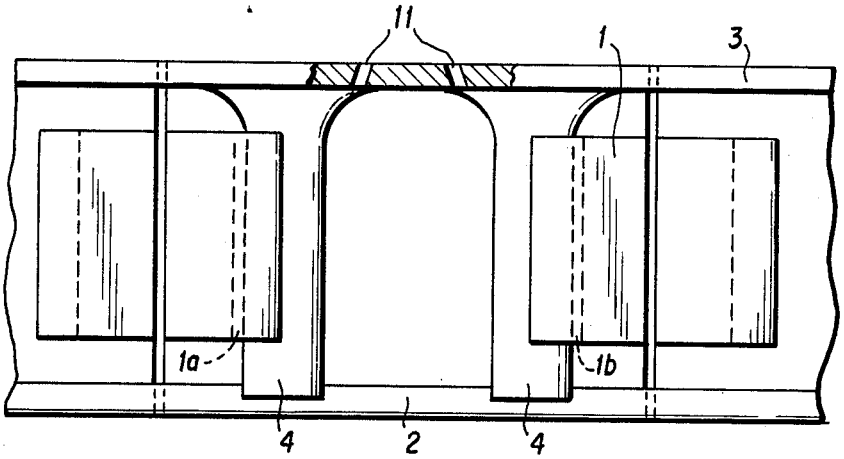
FIG. 2 is a circumferential development, partly in section as viewed from the line II—II of FIG. 1.

The turbine ring illustrated in the drawings is constituted by a circumferential succession of sectors 1 of suitable ceramic abradable material such as a known composite formed from silicon carbide fibres embedded in a matrix of the same material, having a high strength at elevated temperatures, a poor thermal conductivity and good abradable properties.

Each ceramic sector 1 comprises two grooves 1*a*, 1*b*, extending axially of the turbine, circumferentially spaced and with end surfaces or flanks contiguously face-to-face with one another. These grooves 1*a*, 1*b* enable the mounting of sectors 1 on support fingers 4 projecting in the axial sense from an upstream annular member 3 connected in the upstream direction to the turbine casing (not shown) at a flange 3*a* and to a downstream annular member 2. The annular member 2 includes a radially-inwardly extending, circumferential flange, an axially-extending cylindrical portion having apertures for gas flow F2 and a radially-outwardly extending flange parallel to but spaced from the first mentioned flange. The first mentioned flange has machined recesses 8 to enable accurate centering of the support fingers 4.

The annular member 2 is secured at the second-mentioned flange to the upstream annular member 3. The upstream annular member itself includes a relatively downstream radially-inwardly extending flange, an intermediate axially-extending cylindrical portion and the radially-outwardly extending flange 3*a*. Opposed faces of the relatively downstream flange of the member 3 and of the radially-inwardly extending flange of the member 2 each have annular ridges for a purpose to be described hereinafter.

The support fingers 4 are of rectangular section but with well radiussed corners and the portions adjoining the member 3 are well radiussed to eliminate any notching effect. Both annular members 2 and 3 form parts of an annular carrier for the sectors 1.

Springs 5 of omega shape maintain the sectors 1 in firm abutment, radially against the fingers 4. Sealing between two adjacent sectors 1 is provided by a strip 6 (of the same composite ceramic material for example) which can slide axially in two opposed grooves 1*c*, 1*d* machined in the opposed flanks of the sectors 1. The strips 6 are illustrated purely diagrammatically and will, in practice, be a good sliding fit.

Cooling of the turbine ring assembly is carried out in the following manner:

A cavity 9 defined by each sector 1 and a sheet metal member 7 exists at a pressure in excess of the pressure in the main gas turbine flow owing to the admission of air at the radially inner zone of the chamber, drawn from the enclosure of the combustion chamber, which serves to prevent return of hot air from the main gas turbine flow. The sectors 1 are mounted, when cold, lightly biased from downstream and from the upstream directions, which results, when hot, in a slight clearance enabling the discharge of pressure air from the cavity 9 and the cooling of the annular members 2 and 3 at their inner radius, as illustrated by the arrows F1 in FIG. 3.

Figure 3:
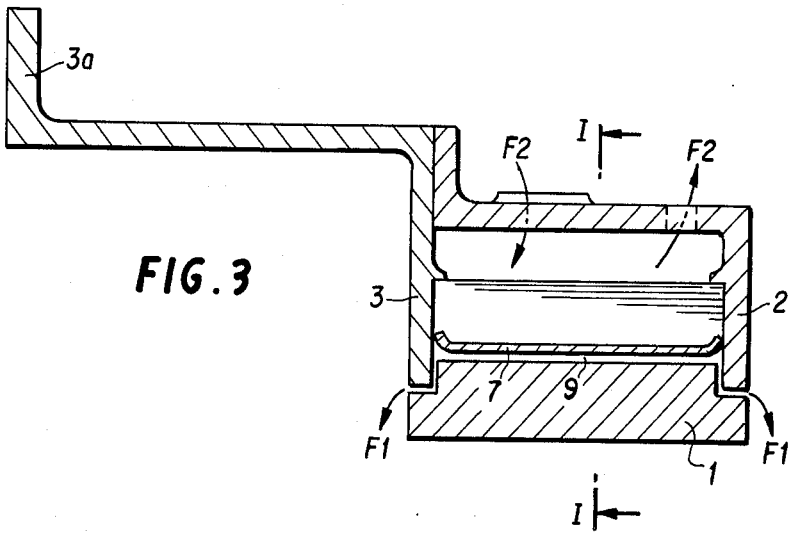
FIGS. 3 and 4 are views in radial section on the lines III—III and IV—IV respectively of FIG. 1.
Figure 4:
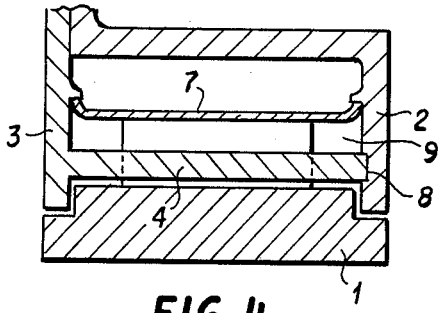

The sheet metal member 7 separates the cavity 9 from a radially outer cavity 10. The sheet metal member 7 is located on the opposed ridges, hereinbefore referred to, of the annular carrier and as can be seen in FIG. 1 is of sinuous annular form. The edges are bent radially outwardly as seen in FIGS. 3 and 4 to provide a sealing action. In the cavity 10, control air is caused to flow, as illustrated by the arrows F2, thus enabling the control of the expansions and contractions of the assembly by controlling the temperature of the annular members 2 and 3. This control air for the annular carrier may be bled from an intermediate stage of the compressor and used subsequently for other cooling effects (for example the downstream low pressure turbine inlet nozzle guide vanes) or it may be merely exhausted into the secondary duct of a by-pass engine.

Figure 5:
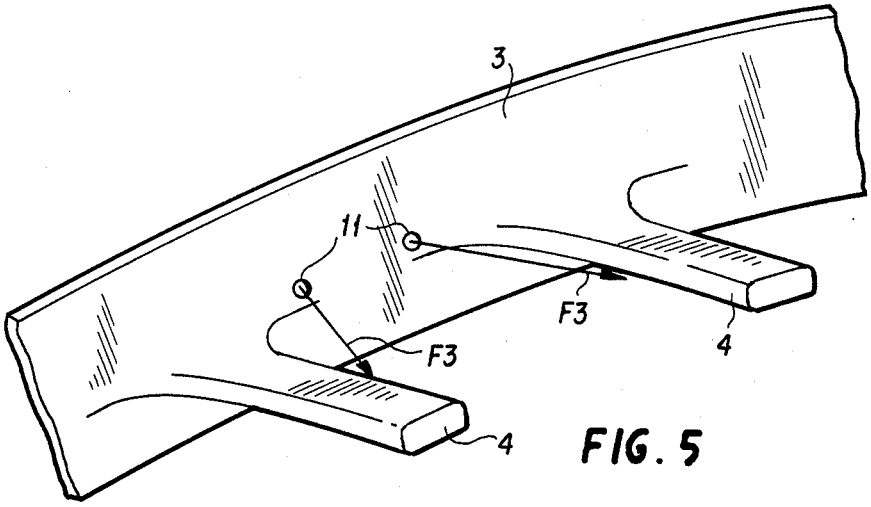
FIG. 5 illustrates in perspective the configuration of support fingers rigid with an annular member of the assembly of the turbine.

The support fingers 4 are cooled by air jets F3 delivered from orifices 11 inclined as indicated by the arrows in FIG. 5. This cooling air from the annular carrier can be bled from an intermediate stage of the compressor and discharged subsequently into the secondary duct. The location of the grooves 1*a*, 1*b* enables the disposition of the support fingers 4 in a cooler zone whilst nevertheless enabling an elevated temperatue of the annular sectors 1, the selected shape enabling effective thermal protection of the support means.

While ensuring a good service life of the sectors of ceramic material the construction of the preferred embodiment also gives rise to the advantages which flow of thermal protection of the stator, and reduction in the cooling flow required by the sectors because of their poor thermal conductivity.

It will be readily apparent that the embodiment herein described is only one example and it is possible to modify the construction, particularly by substitution of equivalent techniques, without departing from the scope of the invention.

What is claimed is:

1. In a turbine ring assembly:

a turbine casing;

an annular carrier secured within said casing and including an annular member;

an annulus comprising a circumferentially extending array of abradable ceramic sectors, each of said sectors having radially inner and outer surfaces and circumferentially end surfaces, said sectors being contiguous at said end sufaces and each including:

(a) a recess in said radially outer surface, (b) first axially extending grooves in circumferential ends of said recess, said first grooves facing one another and defining a pair of hook portions extending circumferentially towards one another at said radially outer surface of said sector, and (c) second axially extending grooves in said end surfaces, whereby second grooves of adjacent sectors face one another;

a plurality of support fingers extending axially from said annular member, each of said support fingers extending through one of said first grooves; and sealing tongues fitted in each pair of said facing second grooves.

2. An assembly according to claim 1, wherein said annular member has orifices inclined relative to the axial direction and each arranged to direct a cooling air jet on to an adjacent said support finger.

3. An assembly according to claim 1, comprising a further annular member forming a part of the annular carrier, and having a radially-inwardly directed face, springs of omega shape interposed between radially outer faces of the sectors and the radially inwardly-directed face of said further annular member thereby ensuring positive contact between the support fingers and the material of the sectors defining the grooves.

4. The assembly of claim 3 including a metal sheet resting on said radially outer surfaces of said sectors and dividing a space between said further annular member and said sectors into two cavities, means for supplying one of said cavities with cooling air for cooling said sectors, and means for supplying the other of said cavities with cooling air for controlling clearances in the turbine, wherein said springs are positioned to press said metal sheet onto said radially outer surfaces of said sectors.

* * * * *